United States Patent [19]

Arteaga et al.

[11] 4,133,531

[45] Jan. 9, 1979

[54] PORTABLE DEVICE FOR USE IN PLAYING STEP-BALL

[76] Inventors: Eldon F. Arteaga, 8442 Edna St., St. Louis, Mo. 63147; James J. Lydon, Jr., 555 Main, Rm. 434, Beaumont, Tex. 77704

[21] Appl. No.: 780,515

[22] Filed: Mar. 23, 1977

[51] Int. Cl.[2] ..... A63B 63/04

[52] U.S. Cl. ..... 273/102 R

[58] Field of Search ..... 272/70, 21, 25; 108/111, 112; 182/152, 132, 160; 52/183, 184, 182; 273/102 R, 102 S

[56] References Cited

U.S. PATENT DOCUMENTS

| | | | |
|---|---|---|---|
| 473,783 | 4/1892 | Rieckert | 108/112 |
| 606,532 | 6/1898 | Furness | 52/182 |
| 633,018 | 9/1899 | Lotto | 272/25 |
| 1,125,194 | 1/1915 | Sigmund | 52/183 |
| 1,511,430 | 10/1924 | Schonberg | 273/102 R |
| 1,754,130 | 4/1930 | Uchiyama | 273/102 R |
| 2,859,488 | 11/1958 | Mackintosh | 52/183 |
| 3,035,671 | 5/1962 | Sicherman | 189/43 |
| 3,564,790 | 2/1971 | Rehfeld | 52/183 |
| 3,876,070 | 4/1975 | Nagy | 273/95 R |

FOREIGN PATENT DOCUMENTS

| | | | |
|---|---|---|---|
| 354067 | 11/1930 | United Kingdom | 108/112 |

*Primary Examiner*—William H. Grieb
*Assistant Examiner*—Lawrence E. Anderson
*Attorney, Agent, or Firm*—Koenig, Senniger, Powers and Leavitt

[57] ABSTRACT

A portable device for use in playing step-ball or the like comprising a plurality of steps arranged in a flight, each step having a front face and a top face which a ball may strike. First and second panels form side enclosures for the flight of steps and a removable front panel encloses the front of the flight of steps. A top panel encloses the top of the flight of steps and is movable from a closed position extending between the side panels over the flight of steps to an upright open position in which it forms a backstop at the back of the top step for a ball directed at the flight of steps.

9 Claims, 4 Drawing Figures

PORTABLE DEVICE FOR USE IN PLAYING STEP-BALL

BACKGROUND OF THE INVENTION

This invention relates to game equipment and more particularly to a portable device for use in playing step-ball.

Step-ball is a game involving one or more players in which a ball is thrown at a flight of steps to strike one of the steps and rebound back toward the players. The object of the game is for a player to catch a ball thrown at the flight of steps after it has rebounded off one of the steps.

SUMMARY OF THE INVENTION

Among the several objects of the present invention may be noted the provision of portable device for use in playing step-ball; the provision of such a device which may be readily transported to a convenient outside location such as a vacant lot so a game may be played away from pedestrians and traffic or to an inside location such as the basement of a house so a game may be played even in inclement weather; the provision of such a device which is quickly and simply readied for play after a playing site is reached; the provision of such a device which is conveniently stored when not in use; and the provision of such a device which is easy to construct and low in cost.

Briefly, a portable device of the invention for use in playing step-ball or the like comprises a plurality of steps arranged in a flight, each step having a front face and a top face which a ball may strike. First and second panels form side enclosures for the flight of steps and a removable front panel encloses the front of the flight. A top panel encloses the top of the flight and is movable from a closed position extending between the side panels over the flight of steps to an upright open position in which it forms a backstop at the back of the top step for a ball directed at the flight of steps. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
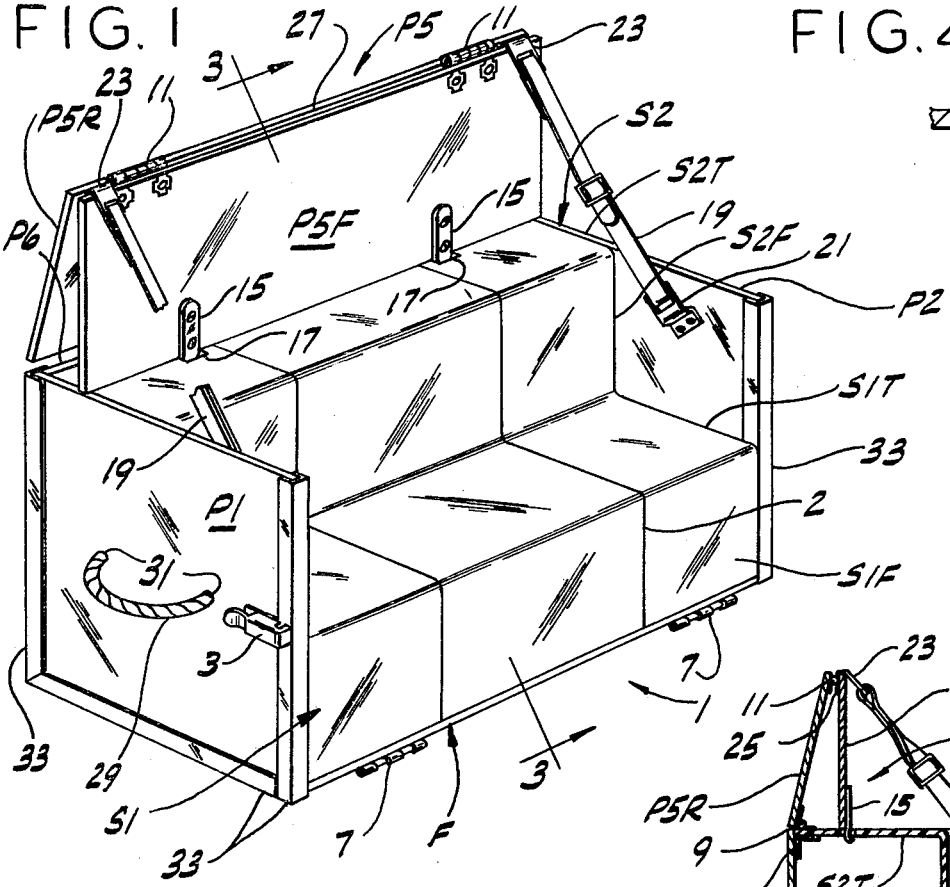
FIG. 1 is a perspective view of a portable device of the present invention having a front panel which is removed and a top panel which is in an upright position forming a backstop.
Figure 4:
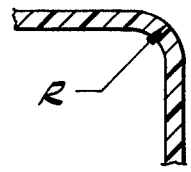
FIG. 4 is a broken away view of FIG. 3 showing the radius of curvature of the outer surface of one of the steps in the region where the top and front faces of the step meet.

Referring now to the drawings, a portable device of the present invention for use in playing step-ball or the like is indicated in its entirety at 1 and includes a plurality of steps S arranged in a flight generally designated F. As shown in FIG. 1, flight F is comprised of two steps S1 and S2, each step having a top face, S1T and S2T, respectively, which a ball (not shown) may strike when thrown at the flight of steps by a step-ball player and a front face S1F and S2F, respectively, which extends down from the top face at the front thereof (i.e., the top face does not overhang the front face) to the top face of the step below. The flight of steps may be integrally formed as shown in FIG. 1, although it will be understood that each step may be separately constructed and then united to form flight F. As shown in FIG. 4, the outer surface of each step is curved in the region where the front face or riser of the step meets the top face or tread of the step. The radius R of curvature of the surface affects the way in which a ball striking the step in this region rebounds and for this purpose, the radius of curvature is preferably in the range between 5/16 inch and ½ inch. It will be understood that the two faces of each step may be perpendicular to each other at their juncture. Also, the steps may be made of any suitable material capable of withstanding the forces imparted to the steps when struck by a ball. Additionally, a stripe 2 extends down the middle of the flight of steps. The stripe, which is a contrasting color to the color of the steps, defines a strike zone on the steps. The stripe may be applied to the flight of steps in any convenient manner, i.e., by painting it on or applying a tape to the steps, and the width of the stripe is the same as the width of a home plate used in baseball, i.e., 12 inches.

Figure 2:
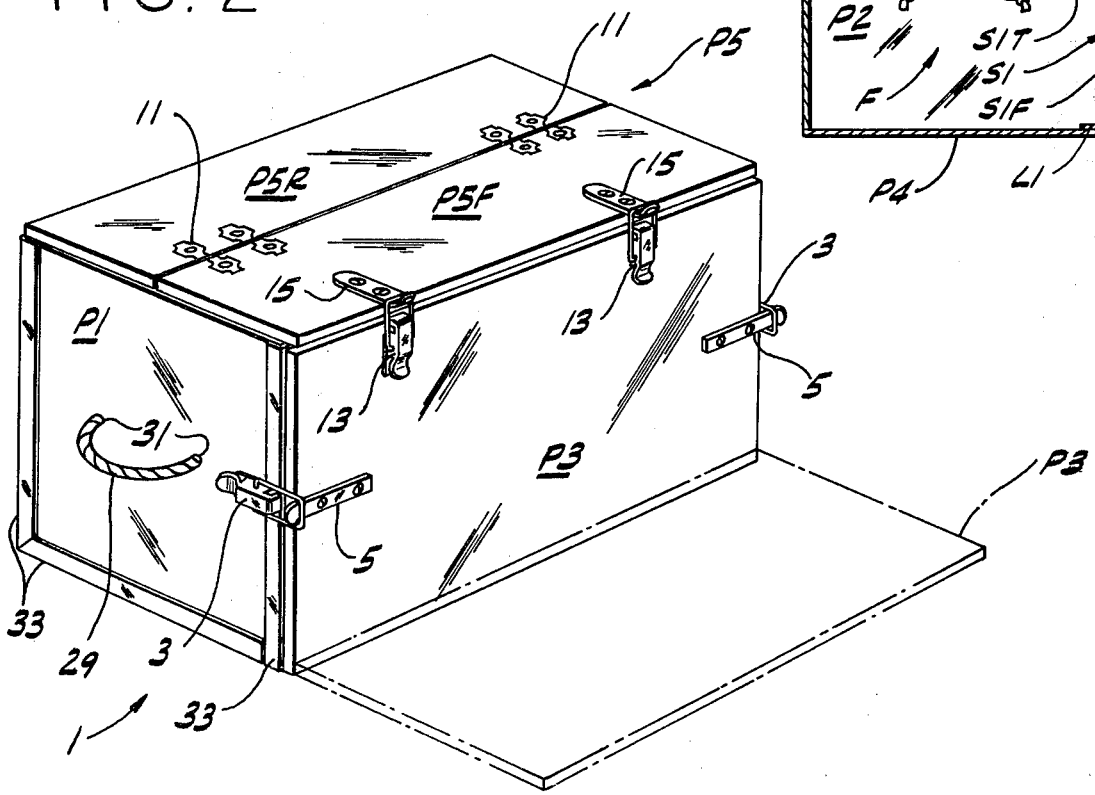
FIG. 2 is a perspective view of the portable device of FIG. 1 with the front panel in place and the top panel in a closed position.

First and second panels P1 and P2 form respective side enclosures for the flight of steps and the panels have length and height dimensions corresponding to the depth and rise of flight F. A front panel P3 is removably attachable to the side panels and, as shown in FIG. 2, encloses the front of the flight of steps when in place. A draw-pull fastener 3, for example, is mounted on each side panel P1 and P2 at the front end thereof, with the bail of each fastener engageable with a keeper 5 mounted at a respective side edge of front panel P3 at a position corresponding to that of fastener 3 for lockingly engaging the keeper and attaching the front panel to the side panels. A bottom panel P4 encloses the bottom of the flight of steps and front panel P3 is hingedly attached to the bottom panel by a pair of hinges 7. This permits the front panel to be rotated forward to the dashed line position shown in FIG. 2 to lie flat on the ground or other surface when the front panel is detached from the side panels. The portions of each hinge attached to the front and bottom panels are separable, as shown in FIG. 1, so the front panel may be detached from the bottom panel and set aside while a step-ball game is played.

A top panel, generally indicated P5, encloses the top of the flight of steps and is comprised of a front section P5F and a rear section P5R which are equal in size so that each section comprises half of the top panel. The top panel is movable from a closed position (shown in FIG. 2) extending between side panels P1 and P2 to an upright open position (shown in FIG. 1) in which the top panel forms a backstop at the back of top step S2 for a ball directed at the flight of steps. A back panel P6 encloses the back of the flight of steps and top panel P5 is hingedly attached to the back panel by a pair of hinges 9, one of these hinges being shown in FIG. 3. More specifically, the hinges permit rotation of rear section P5R of the top panel for moving the top panel from its closed to its upright position. Further, the front and rear sections of the top panel are hingedly attached to each other by a pair of hinges 11 which are installed on the underside of the top panel. This permits rotational movement of the front section P5F relative to rear section P5R as top panel P5 is moved to its upright position so that the top panel is folded over to form the backstop. The height of the backstop when formed is approximately one-half the width of the top panel when the panel is in its lowered position.

Front panel P3 is removably attached to top panel P5 as, for example, by a pair of draw-pull fasteners 13 mounted on the front panel at its upper end. Each fastener has a keeper 15 mounted on the top panel at the forward end of the front section (at a location corresponding to that of the fastener) and projecting outwardly therefrom.

Two slots 17 are provided in the top face of top step S2 for receiving keepers 15 when the top panel is formed into a backstop, and the front section P5F is thereby secured in a fixed position. Two adjustable straps 19 each have an end 21 mounted on the inner face of respective side panels P1 and P2. An anchor 23 at the other end of each strap has a finger 25 removably insertable into an opening 27 created between the front and rear sections of top panel P5 when the backstop is formed. After the fingers of the straps are in place, the backstop is rigidized by adjusting the tension on the front section of the top panel with the straps.

A handle 29 is provided on at least one of the panels for carrying device 1. Preferably, two handles are provided, each handle, for example, being a rope attached to one of the side panels. The handles project outwardly from the panels so as to be easily grasped when the device is to be lifted. Two holes 31 are formed in each side panel for attaching the rope handles to the side panels.

Figure 3:
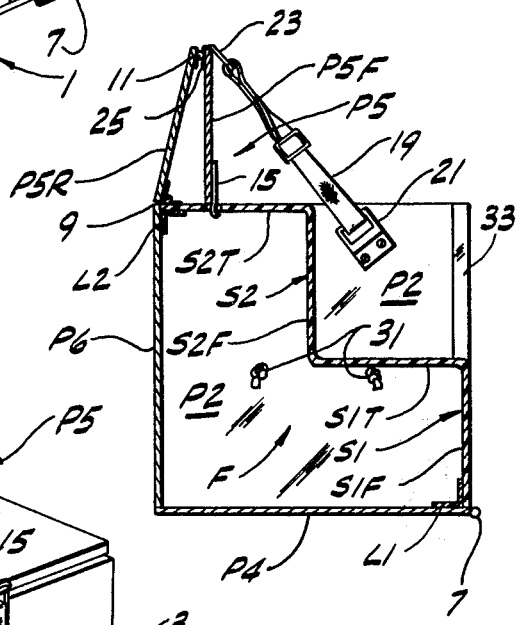
FIG. 3 is a sectional view of the device of FIG. 1 taken along line 3—3 in FIG. 1.

The side, bottom and back panels of device 1 are secured to each other in any suitable manner, as for example, by using angle ties 33. Flight F of steps S is secured to the panels in any suitably convenient manner. As shown in FIG. 3, for example, a first L-shaped bracket L1 has one leg affixed to the upper surface of bottom panel P4 (at the forward end of the panel) by suitable attachments (not shown) and the riser portion of step S1 is affixed to the other leg of the bracket by suitable attachments (also not shown). Similarly, a second L-shaped bracket L2 has one leg attached to the inner face of back panel P6 (at the upper end of the panel) and the tread portion of step S2 is affixed to the other leg of the bracket.

To transport device 1 to a convenient location for playing step-ball, front panel P3 is first attached to side panels P1 and P2 using draw-pull fasteners 3 and top panel P5 is moved to its closed position and attached to the front panel by draw-pull fasteners 13. The handles 29 are then grasped and the device lifted and carried to the chosen location such as a vacant lot or the basement of a house. There, the two pairs of fasteners are released and top panel P5 is moved to its upright position to form the backstop with front section P5F of the top panel folded over and keepers 15 inserted into slots 17. Fingers 25 of anchors 23 are then inserted into the opening formed between the front and rear sections of the top panel and the tension of the straps is adjusted to rigidize the backstop. The front panel may be either lowered to lie flat on the ground or basement floor or it may be detached from bottom panel P4 and set aside. When a game is completed, the front panel is reinstalled and the top panel lowered to its closed position and after fasteners 3 and 13 are refastened the device is carried wherever desired.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A portable device for use in playing step-ball or the like comprising:
   - a plurality of steps arranged in a flight, each step having a top face which a ball may strike, and a front face extending down from the top face at the front thereof to the top face of the step below;
   - flight and second panels forming side enclosures for the flight of steps;
   - a removable front panel for enclosing the front of the flight of steps;
   - a top panel for enclosing the top of the flight of steps, said top panel being movable from a closed position extending between the side panels over the flight of steps to an upright open position in which it forms a backstop at the back of the top step for a ball directed at the flight of steps; and
   - a back panel for enclosing the back of the flight of steps and means for hingedly attaching the top panel to the back panel for moving the top panel from its closed to its upright open position;
   - said top panel comprising a front section and a rear section and being hingedly attached to the back panel at its rear section.

2. A device as set forth in claim 1 further including means for hingedly attaching the front and rear sections of the top panel to each other for movement of the front section relative to the rear section as the top panel is moved to its upright open position whereby the top panel is folded over to form the backstop.

3. A device as set forth in claim 2 wherein the front and rear sections of the top panel are substantially equal in size and the height of the backstop is approximately one-half the width of the top panel when said top panel is in its lowered position.

4. A portable device for use in playing step-ball or the like comprising:
   - a plurality of steps arranged in a flight, each step having a top face which a ball may strike, and a front face extending down from the top face at the front thereof to the top face of the step below;
   - first and second panels forming side enclosures for the flight of steps;
   - a removable front panel for enclosing the front of the flight of steps;
   - a top panel for enclosing the top of the flight of steps, said top panel being movable from a closed position extending between the side panels over the flight of steps to an upright open position in which it forms a backstop at the back of the top step for a ball directed at the flight of steps;
   - fastening means for removably attaching the front panel to the side panels; and
   - a bottom panel for enclosing the bottom of the flight of steps and means for hingedly removably attaching the front panel to the bottom panel so the front panel may be rotated forward to lie flat on a surface when detached from the side panels and detached from the bottom panel to be set aside while step-ball is being played.

5. A portable device for use in playing step-ball or the like comprising:

a plurality of steps arranged in a flight, each step having a front face and a top face which a ball may strike;

first and second panels forming side enclosures for the flight of steps;

a removable front panel for enclosing the front of the flight of steps;

a top panel for enclosing the top of the flight of steps, said top panel being movable from a closed position extending between the side panels over the flight of steps to an upright open position in which it forms a backstop at the back of the top step for a ball directed at the flight of steps;

a back panel for enclosing the back of the flight of steps and means for hingedly attaching the top panel to the back panel for moving the top panel from its closed to its upright open position, said top panel comprising a front section and a rear section and being hingedly attached to the back panel at its rear section;

means for hingedly attaching the front and rear sections of the top panel to each other for movement of the front section relative to the rear section as the top panel is moved to its upright open position whereby the top panel is folded over to form the backstop; and fastening means for removably attaching the front panel to the top panel, a portion of said fastening means being mounted on said top panel at the forward end of the front section and the top face of the top step having at least one slot therein for receiving said portion of said fastening means when the backstop is formed to secure the front section of the top panel in a fixed position.

6. A device as set forth in claim 5 further including means for rigidizing the backstop when it is formed.

7. A device as set forth in claim 6 wherein the rigidizing means includes a pair of adjustable straps one end of each of which is mounted on the inner face of one of the side panels and the other end of each of which is adapted to be removably inserted into an opening created between the front and rear sections of the top panel when the backstop is formed to rigidize the backstop.

8. A portable device for use in playing step-ball or the like comprising:

a plurality of steps arranged in a flight, each step having a front face and a top face which a ball may strike;

first and second panels forming side enclosures for the flight of steps;

a removable front panel for enclosing the front of the flight of steps;

a top panel for enclosing the top of the flight of steps, said top panel being movable from a closed position extending between the side panels over the flight of steps to an upright open position in which it forms a backstop at the back of the top step for a ball directed at the flight of steps; and means defining a strike zone on the flight of steps, said means comprising a stripe extending down the flight of steps, said stripe being a color contrasting with the color of the steps.

9. A device as set forth in claim 8 wherein the stripe extends down the middle of the flight of steps and the width of the stripe substantially equals the width of a home plate used in baseball.

* * * * *

UNITED STATES PATENT AND TRADEMARK OFFICE

CERTIFICATE OF CORRECTION

PATENT NO. : 4,133,531

DATED : January 9, 1979

INVENTOR(S) : Eldon F. Arteaga and James J. Lydon

It is certified that error appears in the above-identified patent and that said Letters Patent are hereby corrected as shown below:

Column 4, claim 1, line 19, "flight" should read -- first --.

Signed and Sealed this

*First* Day of *May 1979*

[SEAL]

*Attest:*

RUTH C. MASON
*Attesting Officer*

DONALD W. BANNER
*Commissioner of Patents and Trademarks*